US005594954A

United States Patent [19]

Huang

[11] Patent Number: 5,594,954

[45] Date of Patent: Jan. 21, 1997

[54] KNEE-PAD AND ELBOW-PAD

[76] Inventor: Cheng-Yen Huang, P.O. Box 90, Tainan 704, Taiwan

[21] Appl. No.: 612,794

[22] Filed: Mar. 11, 1996

[51] Int. Cl.[6] ..... A41D 13/00; A41D 13/08

[52] U.S. Cl. ..... 2/24; 2/16; 2/22; 2/455

[58] Field of Search ..... 2/16, 2, 24, 911, 2/908, 267, 22, 62; 602/26, 20

[56] References Cited

U.S. PATENT DOCUMENTS

| | | | |
|---|---|---|---|
| 4,484,360 | 11/1984 | Leighton et al. | 2/62 |
| 4,599,747 | 7/1986 | Robinson | 2/20 |
| 4,999,847 | 3/1991 | Barcelo | 2/24 |
| 5,222,256 | 6/1993 | Wang | 2/16 |
| 5,452,475 | 9/1995 | Hunt | 2/22 |
| 5,477,559 | 12/1995 | Clement | 2/22 |
| 5,500,955 | 3/1996 | Gorgea | 2/24 |
| 5,537,689 | 7/1996 | Darcyger | 2/24 |

*Primary Examiner*—Bibhu Mohanty

[57] ABSTRACT

A knee-pad or an elbow-pad has a body made of a layer of lining, a layer of buffer and a surface cloth by means of thermal pressing process. The body has an intermediate, an upper and a lower portion. The intermediate portion additionally has a bowl-shaped plate on an upper surface. The upper and the lower portion respectively have plural lateral ribs on the surface, and each of the ribs has elastic means consisting of an elastic tube and soft metal wires extending in the tube, and grooves are formed between every two ribs so that the body may be easily bent or straightened according to movement of the knee of a user.

6 Claims, 12 Drawing Sheets

KNEE-PAD AND ELBOW-PAD

BACKGROUND OF THE INVENTION

This invention concerns a knee-pad or an elbow-pad, particularly having a body provided with lateral ribs and grooves between every two ribs containing elastic members to bend substantially to suit to bending and straightening movement of a knee or an elbow of a user.

A known conventional knee-pad or elbow-pad 1 shown in FIG. 1 is made of foam rubber and wrapped with a surface cloth and an intermediate outer cap A1. Then external shock is absorbed by the thick foam rubber, but can often have the right and the left side protruding out, impossible to bend together with the knee so that the knee portion to be protected is quite limited because of the portion near the knee being exposed out. Besides, frequent knee bending movement may force the knee-pad move away from the knee so that the knee-pad has to be newly adjusted in its location.

Another known conventional knee-pad or elbow-pad shown in FIG. 2 is formed of hard plastics by means of injecting process, having three portions, namely, an upper portion, an intermediate portion and a lower portion, connected together. However, as this knee-pad has a definite size, impossible to suit every body size, and in addition, hardly bendable to contact closely with the outer surface of the knee and its neighboring portion.

The two kinds of known conventional knee-pad or elbow pads are designed to fit with a knee or an elbow in the straight condition. But a knee of a user in playing a game is often in half or substantially bent condition. For example;

1. Knees of players of hockey, of ice hockey, of goalkeepers of football, of skaters, of skiers, of gliding boarders and of bike racers are almost bent halfway.

2. The knees of catchers of baseball are often bent fully.

3. Elbows of players of many kinds of ball games are often kept in bent condition.

Therefore, the known conventional knee-pads or elbow-pads hardly satisfy need of physical movement in various kinds of sports, giving users tenseness and fatigue in wearing.

SUMMARY OF THE INVENTION

A main purpose of the invention is to offer knee-pads or elbow-pads easily bendable in accordance with bending movement of knees or elbows of a user in wearing, and giving no tense and uncomfortable feeling in wearing for a long period of time.

Another purpose of the invention is to offer knee-pads or elbow-pads adjustable in its lateral surface to the body size of a user, comfortable in wearing, sufficiently protective to the body of a user, and having high shock-absorbing capacity.

The main feature of the invention is the body of a knee-pad or an elbow-pad being made integrally by means of pressing process with a layer of lining, a layer of buffer and a layer of surface cloth, having deep curvature extending to the upper portion, the lower portion, the right side and the left side, and plural ribs and grooves between every two ribs on the upper portion and the lower portion. Each rib has elastic means wrapped inside so as to give substantive elasticity so that the upper portion and the lower portion may easily bend according to bending movement of a knee. And a bowl-shaped protective portion is provided between the upper portion and the lower portion, covering just on the knee of a a user.

BRIEF DESCRIPTION OF DRAWINGS

This invention will be better understood by reference to the accompanying drawings, wherein.

DESCRIPTION OF THE PREFERRED EMBODIMENTS

Figure 1:
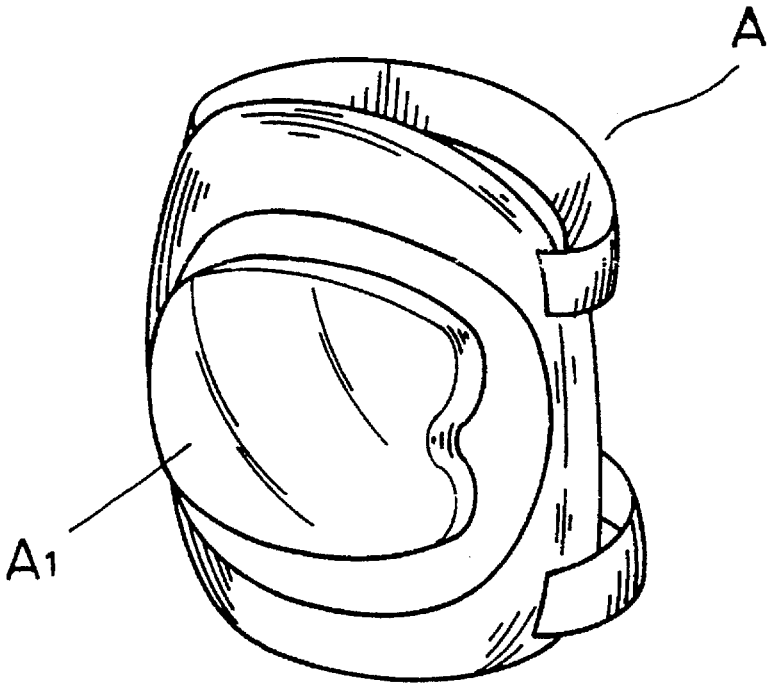
FIG. 1 (PRIOR ART)
FIG. 1 is a perspective view of a known conventional knee-pad.
Figure 2:
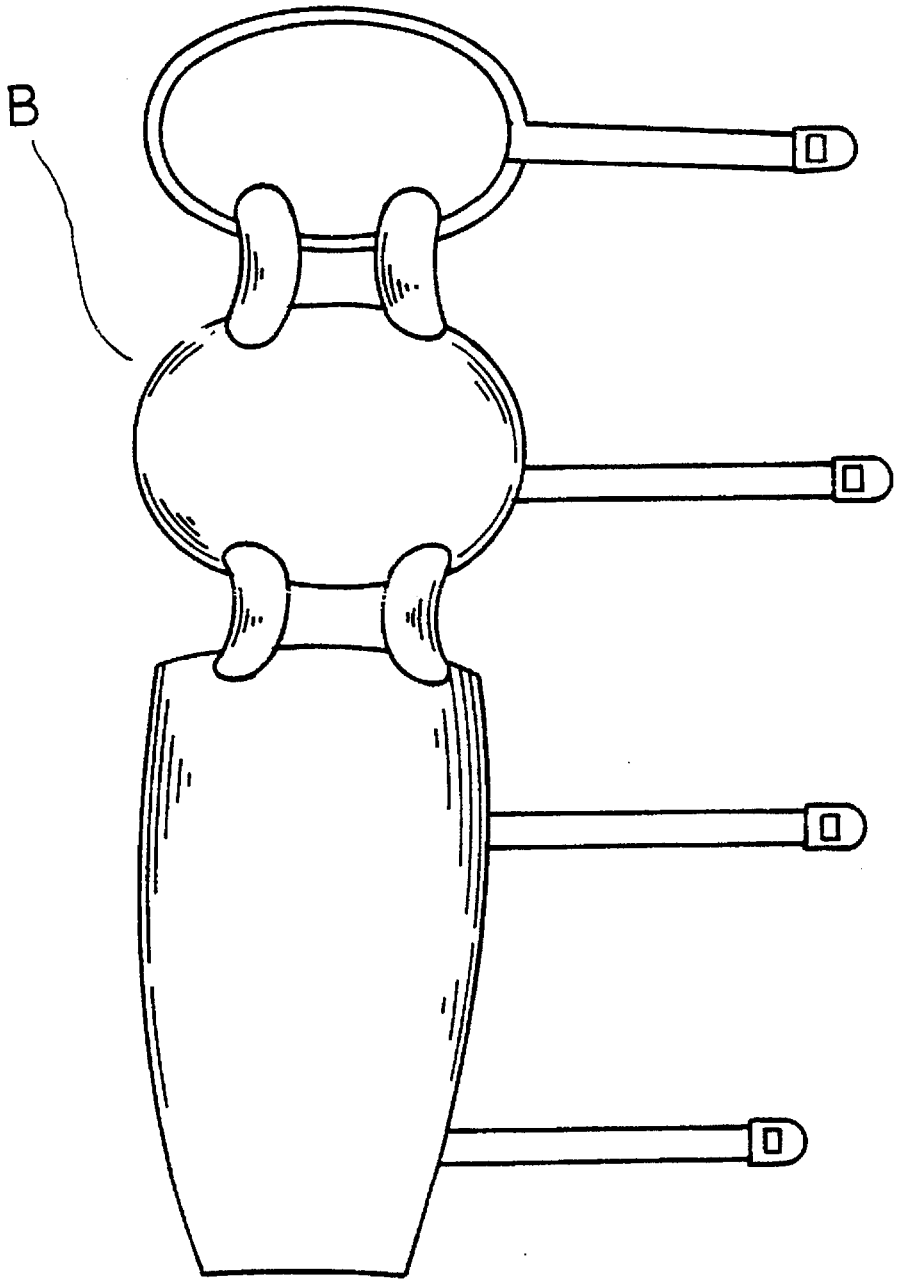
FIG. 2 (PRIOR ART)
FIG. 2 is a perspective view of another known conventional knee-pad.
Figure 3:
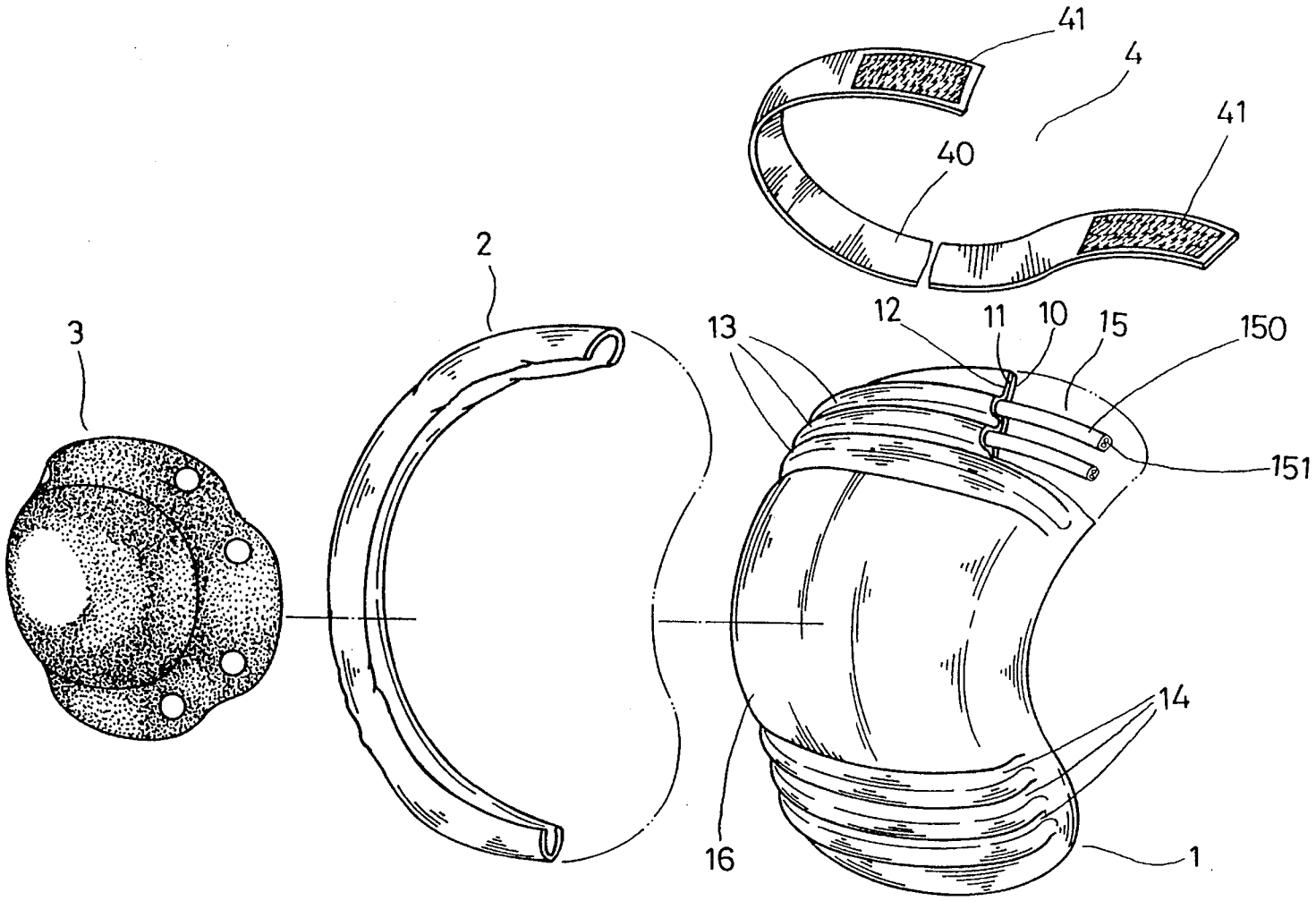
FIG. 3 is an exploded perspective view of a first embodiment of a knee-pad in the present invention.
Figure 4:
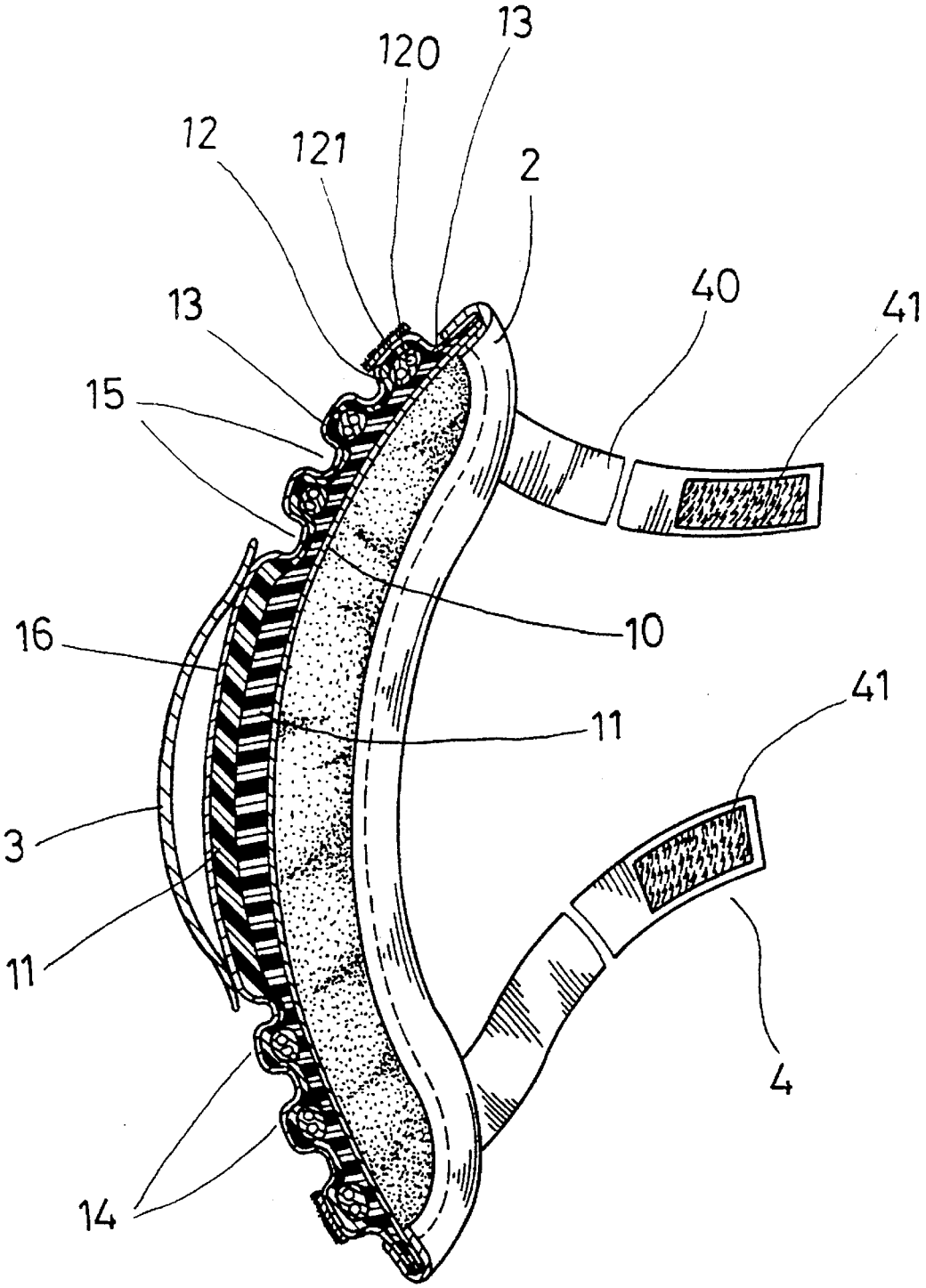
FIG. 4 is a cross-sectional view of the first embodiment of the knee-pad in the present invention.

A first embodiment of a knee-pad or an elbow-pad in the present invention, as shown in FIGS. 3 and 4, includes a body 1 integrally made of a layer of lining 10 of cotton or the like, a layer of buffer 11 of foam rubber of PU or EVA, and a layer of surface cloth 12 of rather thick material by means of thermal pressing process, and shaped curving inward from the middle to the upper portion, the lower portion, the right side and the left side. The body 1 also has a plurality of protective ribs 13 spaced apart laterally and orderly, and grooves 14 formed between every two ribs 13 on the surface of the upper portion and the lower portion. Each protective rib 13 contains an elastic means 15 consisting of an elastic tube 150 and two or more slender metal wires 151 housed in the elastic tube 150. The protective means 15 is set within the buffer 11, and a bowl-shaped protecting portion 16 is formed in an intermediate portion between the upper and the lower portion.

A rim 2 is sewn along an peripheral edge of the body 1, utilizing the left-over surface cloth 12 or colored cloth, to add visional pleasure.

A protective plate 3 is deposited on the protective portion 16, made of rather hard plastics or plastic steel, and shaped as a bowl as the protective portion 16, which is made to have shock-absorbing function.

Several bands 4 are provided for binding the knee-pad on the knee of a user, respectively having an elastic strip 40 and two Velcro strips 41, 41 sewn on two ends of each elastic strip 40, which is sewn on the upper end and the lower end of the body 1.

Figure 5:
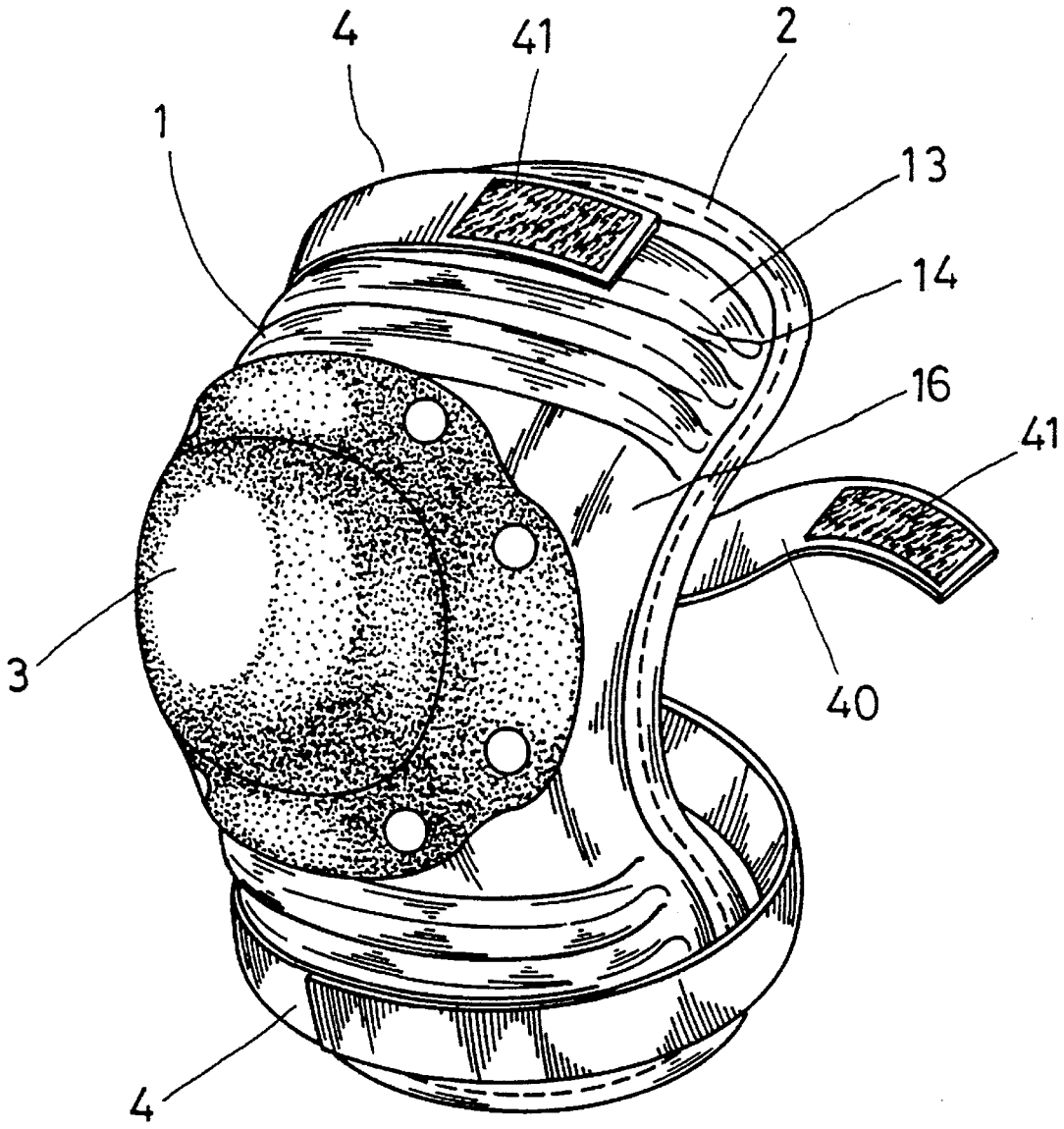
FIG. 5 is a perspective view of the first embodiment of the knee-pad in the present invention.
Figure 6:
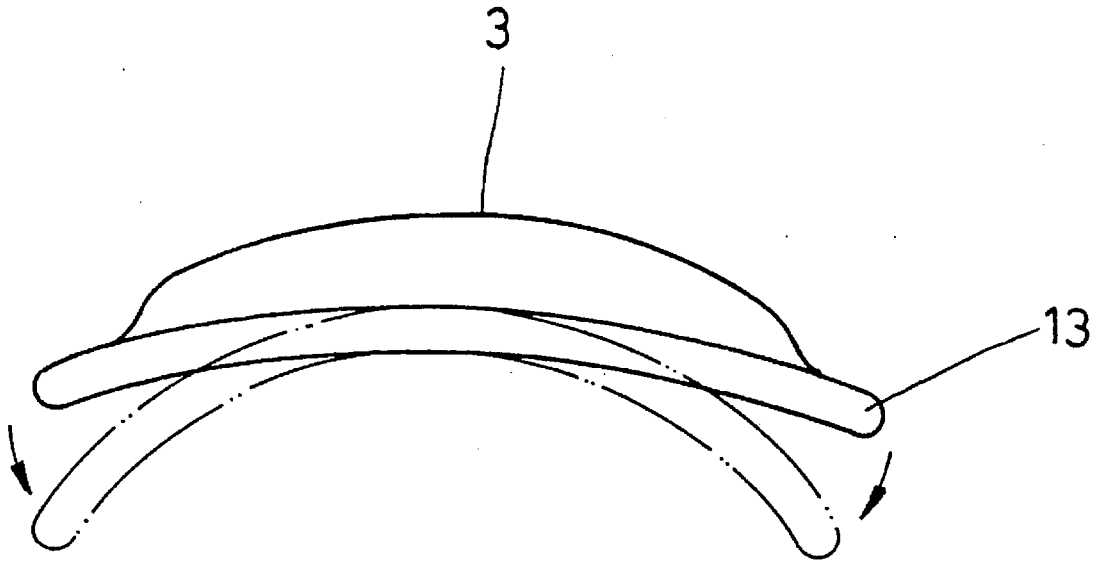
FIG. 6 is a view of an elastic member of the first embodiment of the knee-pad in the present invention, showing it being bent.
Figure 7:
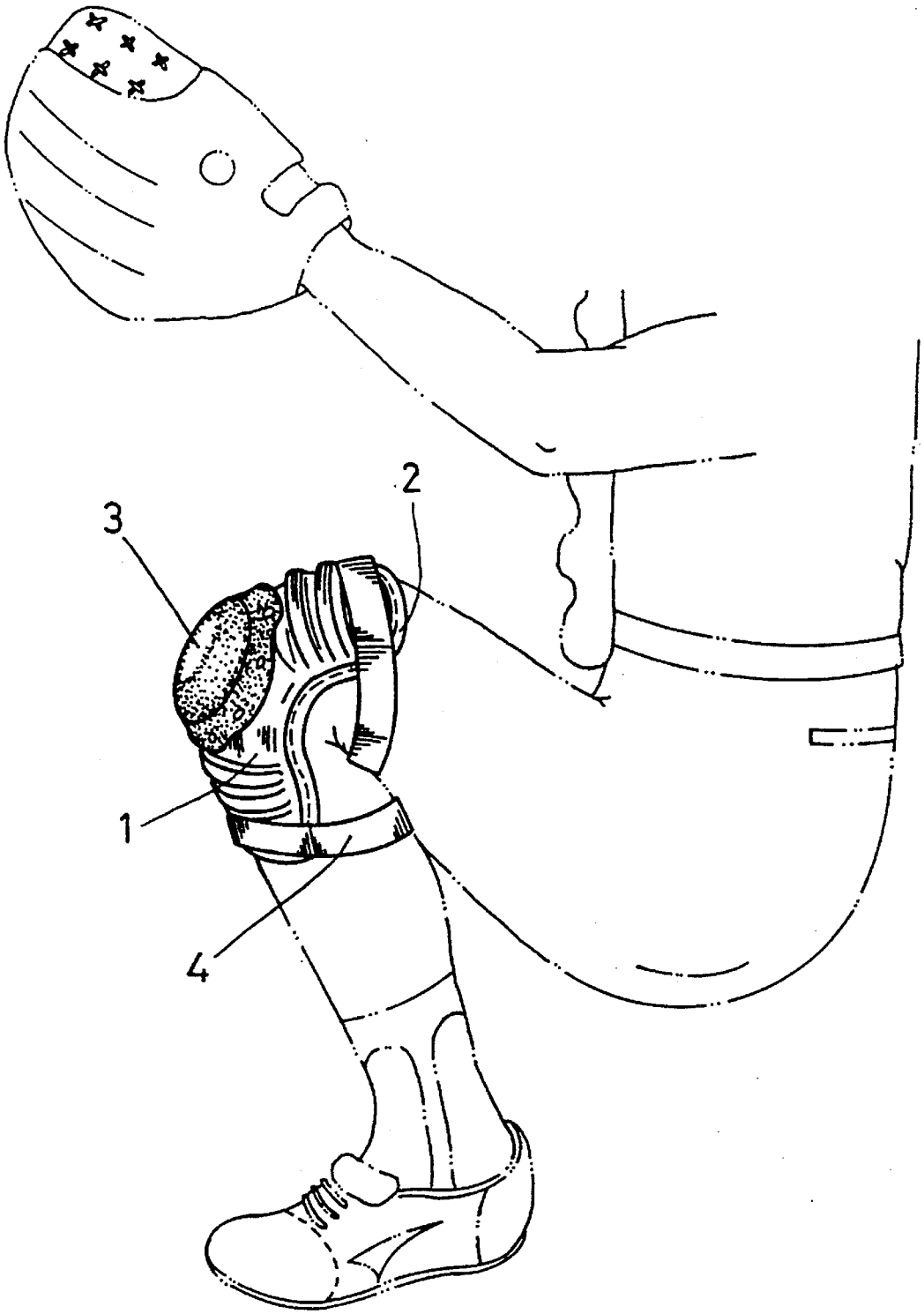
FIG. 7 is a perspective view of the first embodiment of the knee-pad in the present invention, showing it worn on a user.

In assembling, referring to FIGS. 3, 4 and 5, all materials of the body 1, namely, the lining 10, the buffer 11, the elastic means 15 and the surface cloth 12 are orderly placed one on another and then pressed with heat into an integral body 1. After that, the rim 2 is sewn with the peripheral edge of the body 1, and the protective plate 3 is adhered on the protective portion 16 of the body 1. Finally, the bands 4 are sewn laterally with the upper and the lower portion of the body 1 with two ends with the Velcro strips 41, 41 of each elastic strip 40 being in free condition so that the Velcro strips 41, 41 may be engaged with each other around the knee of a user.

In wearing this knee-pad, referring to FIGS. 6, 7, 8 and 9, finally, the elastic means 15 of the body 1 are properly bent into a curve according to the size of the thigh and the leg of a user. Then the protective portion 16 with the protective plate 3 of the body 1 is put just on the knee, with the bands 4 being bound around the thigh and the leg and the two Velcro strips 41, 41 being engaged with each other properly thereon. Is an elbow-pad is to be used, it is also to be bound on the elbow of a user, in almost the same way as described in wearing the knee-pad.

Figure 9:
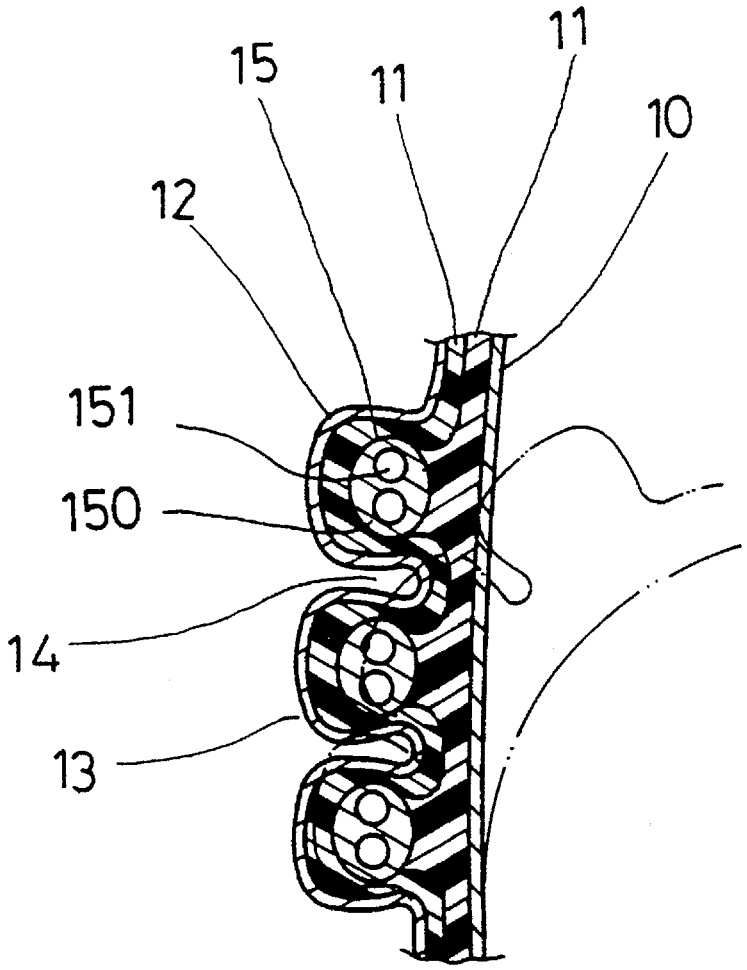
FIG. 9 is a cross-sectional view of a buffer, an elastic member, protective ridges and grooves in the first embodiment of the knee-pad in the present invention.
Figure 10:
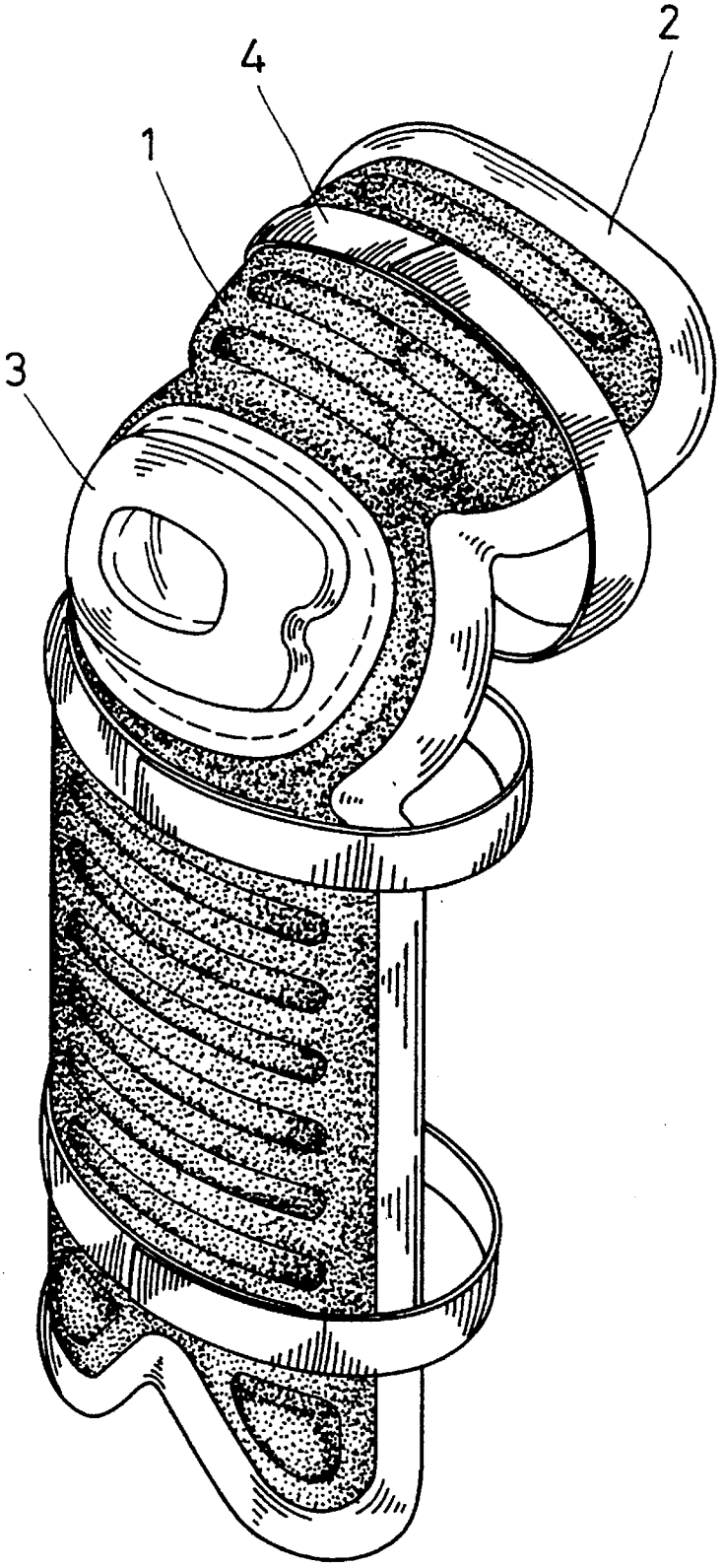
FIG. 10 is another perspective view of the knee-pad in the present invention.

After the knee-pad is worn on and bent in various angles, the grooves 14 of the body 1 may be forced to expand from inside to outside, forming almost continuous U shapes as shown in FIG. 9, and forcing the protective ribs 13 and the rim 2 becoming an expanded protective net. When the knee is straightened out from the bent condition, the grooves 14 become drop-shaped, pushed by the protective ribs 13, as shown in FIG. 9.

If the knee-pad in the present invention is used by a catcher in baseball, the portion provided with the protective ribs 13 and the rim 2 can be prolonged to cover a substantive portion of the leg below the knee so that when an external force is added on this knee-pad, the protective plate 3 has anti-elastic protective function and the buffer 11 contained in the body 1 under the protective portion 16 can absorb shock, lowering possibility of getting hurt and pain during playing a game. In addition, the structure formed by the elastic ribs 13 and the grooves 14 enables the elastic ribs 13 contact with each other as shown in FIG. 9 when a user stands up or straightens the knees, so that the knee-pad in this invention may protect the knee no matter whether it is bent or straightened out.

Figure 8:
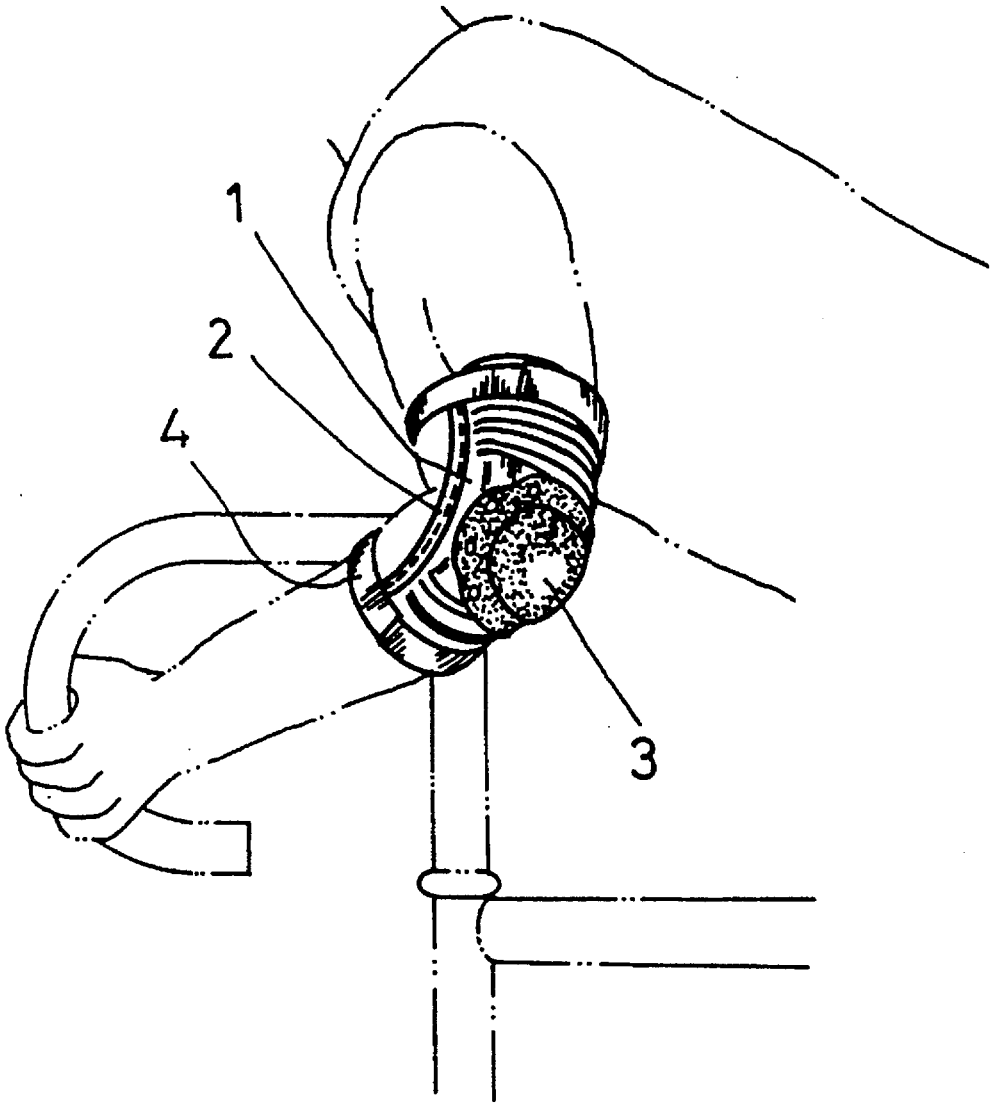
FIG. 8 is a perspective view of first embodiment of an elbow-pad in the present invention, showing it worn on a user.

If an elbow-pad in the present invention is used, such as by a bike racer, as shown in FIG. 8, it can protect the elbows and their neighboring portion in case of very closeness of other racers in racing, by means of the protective plate 3, the protective portion 16, the elastic ribs 13 and the rim 2, and even in case of an accident of falling down from the bike.

The knee-pad and the elbow-pad can also be used by ice hockey players, who often slide on ice with their knees half bent and collide with other players in speedy movement in playing, sometimes resulting in body hurt and wound. Then this invention worn on them can eliminate or lower such wounds on the knees and the elbows whether in bumping with other players or in falling down on ice.

Figure 11:
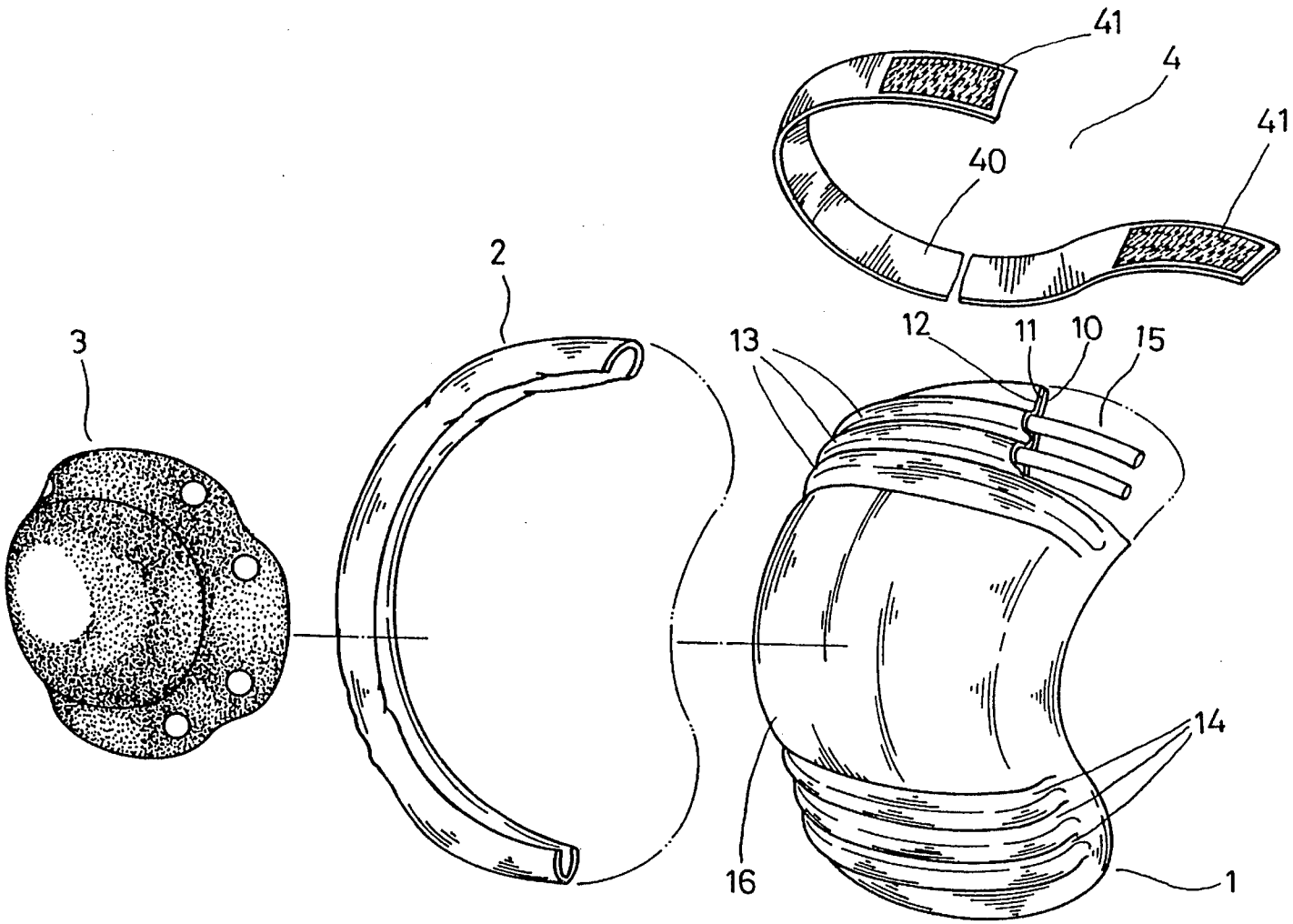
FIG. 11 is an exploded perspective view of a second embodiment of the knee-pad in the present invention.
Figure 12:
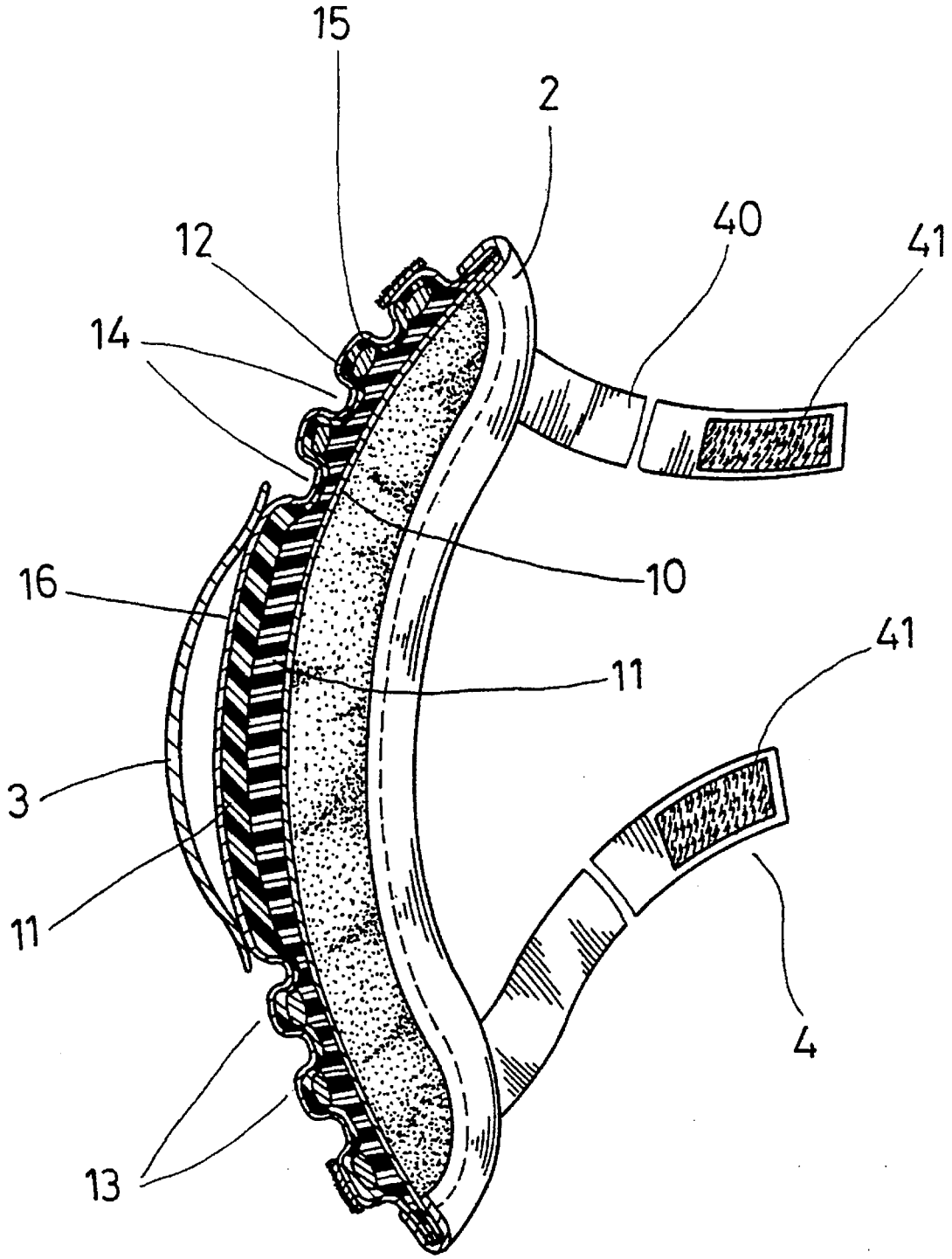
FIG. 12 is a cross-sectional view of the second embodiment of the knee-pad in the present invention.

Further, a second embodiment of the knee-pad or the elbow-pad in the present invention has the same structure as the first embodiment except the elastic means 15, which is made of bar-shaped soft metal, as shown in FIGS. 11 and 12, with the dimensions they cover being adjustable.

As can be understood from the above description, this invention has advantages as listed below.

1. It is made as integral by means of thermal pressing process, simple to manufacture and suitable for mass production.

2. Its components are simple, easy to assemble together, able to be made effectively, and cheap.

3. Its dimensions is made larger than conventional ones, able to function as best protection for the knee or the elbow.

4. Its curved configuration according to physical engineering eliminates tense feeling in wearing, enabling a user move the knees or the elbows at ease without any uncomfortable feeling even in wearing for a long time during playing a game or taking part in a race.

5. The protective ribs with the elastic means can be readily bent in any large angle as needed by a user.

While the preferred embodiments of the invention have been described above, it will be recognized and understood that various modifications may be made therein and the appended claims are intended to cover all such modifications which will fall within the spirit and scope of the invention.

What is claimed is:

1. A knee-pad or an elbow-pad comprising:

a body with its periphery sewn with a protective rim;

a protective plate provided in an intermediate portion of said body between an upper portion and a lower portion thereof, covering the knee of a user;

a plurality of binding means sewn on an upper end and a lower end of said body; and characterized by said body made integral of a layer of lining, a lay of buffer, and a surface cloth by means of thermal pressing process, said body curving from the middle to the upper portion, the lower portion, to the right side and to the left side, by a plurality of lateral ribs spaced apart equidistantly in the upper and the lower portion, by grooves formed between every two of said lateral ribs in the upper portion and the lower portion of said body, by each said rib having an elastic means wrapped inside, by said body having a bowl-shaped protective portion formed in the intermediate portion, and by said body easily being bent for a large angle.

2. The knee-pad or the elbow-pad as claimed in claim 1, wherein said elastic means in each said rib consists of a small elastic tube and soft metal wires extending in said small elastic tube, able to bend easily to form a curve.

3. The knee-pad or the elbow-pad as claimed in claim 1, wherein said elastic means of each said rib is made of soft metal bar able to bend as a curve.

4. The knee-pad or the elbow-pad as claimed in claim 1, wherein said buffer is made of elastic foam rubber having good shock-absorbing function.

5. The knee-pad or the elbow-pad as claimed in claim 1, wherein said rim is made of colored cloth, adding visional pleasure.

6. The knee-pad or the elbow-pad as claimed in claim 1, wherein said binding means is an elastic strip with two hook and loop type fastener strips sewn respectively on two ends of said elastic strip so that said knee-pad or the elbow may be quickly bound on or released from the knee or the elbow by engaging said two hook and loop type fastener strips together or disengaging them from each other.

* * * * *